United States Patent [19]

Höök et al.

[11] Patent Number: 4,878,998

[45] Date of Patent: Nov. 7, 1989

[54] METHOD FOR CONTROLLING PEROXIDE BLEACHING IN A PLURALITY OF BLEACHING STAGES

[75] Inventors: Jan-Erik Höök, Lilla Edet; Görgen Åkerlund, Sollentuna, both of Sweden

[73] Assignee: Eka Nobel AB, Surte, Sweden

[21] Appl. No.: 210,281

[22] PCT Filed: Oct. 14, 1987

[86] PCT No.: PCT/SE87/00467

§ 371 Date: Jun. 20, 1988

§ 102(e) Date: Jun. 20, 1988

[87] PCT Pub. No.: WO88/02796

PCT Pub. Date: Apr. 21, 1988

[30] Foreign Application Priority Data

Oct. 20, 1986 [SE] Sweden ..... 8604459

[51] Int. Cl.[4] ..... D21C 9/16

[52] U.S. Cl. ..... 162/49; 162/62; 162/78

[58] Field of Search ..... 162/49, 238, 24, 25, 162/78, 62, 61

[56] References Cited

U.S. PATENT DOCUMENTS

| | | | |
|---|---|---|---|
| 3,729,375 | 4/1973 | Chappelle | 162/49 |
| 4,013,506 | 3/1977 | Histed et al. | 162/49 |
| 4,160,693 | 7/1979 | Lindahl et al. | 162/24 |
| 4,192,708 | 3/1980 | Bergstrom et al. | 162/238 |
| 4,294,653 | 10/1981 | Lindahl et al. | 162/25 |

FOREIGN PATENT DOCUMENTS

| | | |
|---|---|---|
| 0191756 | 8/1986 | European Pat. Off. . |
| 2309119 | 9/1973 | Fed. Rep. of Germany . |
| WO84/02366 | 6/1984 | PCT Int'l Appl. . |

OTHER PUBLICATIONS

Burnett; *Pulp & Paper Magazine of Canada,* vol. 71, No. 14; Jul. 17, 1970, pp. 57–62, "Computer Control of the Chlorine Stage".

Yamashita; "Control of the Bleaching Process by Cormec", *Pulp & Paper Canada,* 33:8 (1982), pp. 19–20.

Danforth; *Tappi,* vol. 58, No. 3, 3–1975, pp. 91–94, "Bleach Plant Computer Control".

*Primary Examiner*—Steve Alvo

*Attorney, Agent, or Firm*—Burns, Doane, Swecker & Mathis

[57] ABSTRACT

Method of peroxide bleaching of mechanical, thermo-mechanical and chemi-mechanical pulp wherein the peroxide bleaching is controlled by addition of a known amount of bleaching chemicals in the first stage which amount is allowed to react under defined conditions whereafter the brightness of the pulp after this first stage is used for control of a subsequent stage. In the first stage fresh chemicals, chemicals recirculated from a subsequent bleaching stage or a mixture of these is used. Hydrogen peroxide is the preferred bleaching agent but other peroxides can also be used.

21 Claims, 3 Drawing Sheets

METHOD FOR CONTROLLING PEROXIDE BLEACHING IN A PLURALITY OF BLEACHING STAGES

The invention relates to a method of controlling peroxide bleaching of mechanical, thermomechancial or chemi-mechanical pulp.

For several products, such as soft tissue, paperboard and different types of fine paper, it has started to become more and more common to use bleached mechanical or chemi-mechanical pulps instead of fully bleached chemical pulps. Besides the fact that the production of mechanical pulp is much more attractive from an environmental point of view than the production of chemical pulp, the raw materials are also more efficiently utilized. This means that mechanical pulp can be produced at a considerably lower cost and, in several aspects, mechanical pulp also has better properties than the chemical pulp. However, up to now a disadvantage of the mechanical pulp has been a lower brightness which has limited its use in several types of products.

As a consequence of the development of the peroxide bleaching process, for example by beaching in several stages and at high pulp concentrations, it has been possible to increase the brightness and at the same time reduce the costs for chemicals. Previous bleaching systems, both one and two stage systems, have, however, shown a considerable disadvantage in that the possibilities of controlling, regulating and optimizing the bleaching have been limited.

In existing bleaching plants the control is in the simplest case based on measurement of the brightness of the incoming pulp and the brightness value is then used directly for adjustment of the addition of bleaching chemicals. According to another system, which is more common, the brightness of the pulp is measured after the addition of the chemicals and after a defined reaction time of between 1 and 5 minutes. The brightness value is then used for "feed-back " regulation of the addition of the chemicals.

The brightness of the unbleached pulp is, however, not a satisfactory measure of the bleachability of the pulps and changes in the brightness can depend on several factors which influence the relation between the chemical addition and the brightness of the finished pulp in various ways. The raw material can thus vary with regard to content of rotten material, storage time, bark content and blends of different types of wood. The process conditions vary with the blends of chemicals, differences in degree of beating, the temperature and the treatment times and these and other factors influence the relation between the addition of chemicals and the brightness of the finished pulp in different ways.

The present invention will now be disclosed in more detail with reference to the appended drawings.

Figure 1:
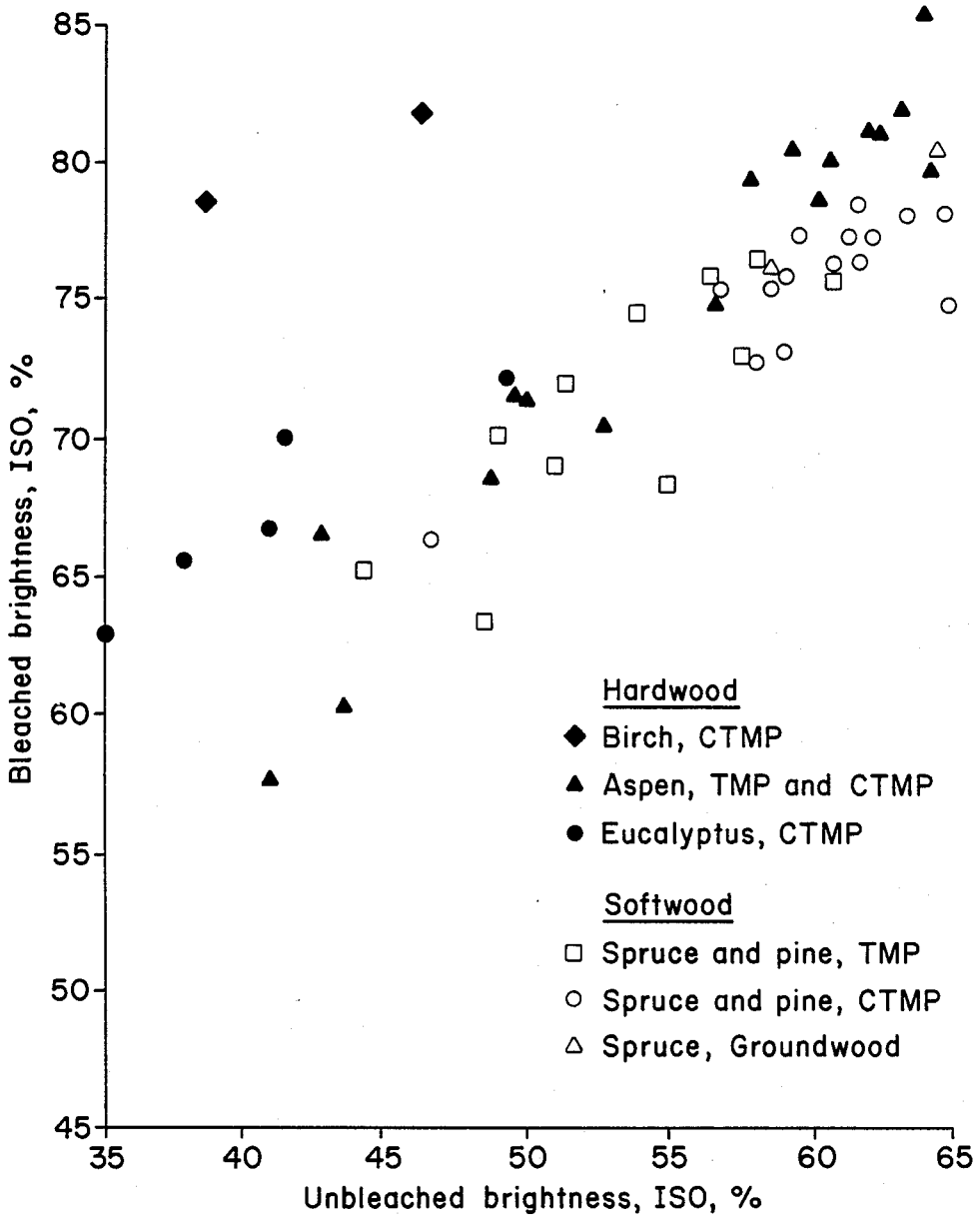
FIG. 1 shows the brightness of pulp at bleaching according to a previously known method.

In FIG. 1 the brightness of pulps bleached in laboratory is shown as a function of the brightness of the unbleached pulp. The peroxide addition has in all cases been 40 kg/t $H_2O_2$ and the addition of alkali has been optimized. The bleaching has been carried out on pulps produced in different manners, TMP, CTMP and groundwood pulp, and from different types of wood, birch, aspen, eucalyptus, spruce and pine wood. All the pulps were bleached under identical conditions and the poor correlation between unbleached and bleached brightness is clearly evident.

In closed systems, for example groundwood mills and TMP-plants, wherein the white water from the bleaching plant is used for dilution after the defibration the brightness of the incoming pulp will of course be an even poorer basis for the control. The brightness of incoming material to the bleaching plant will in these cases be strongly dependent on the amount of residual bleaching chemicals which are recycled with the white water and this residual amount is in turn set by the degree of system clsorue and the amount of residual chemicals from the bleaching. An increased brightness in the feed material to the bleaching plant in such a system does not necessarily mean that the bleachability of the pulp hase been improved, but only that a somewhat greater part of the first "simple "part of the bleaching has already been carried out by the residual chemicals.

A system with measurement of brightness after a certain reaction time, and "feed-back "-regulation of the addition of chemicals will thus be more or less unusable in feed-back systems which has been clearly evident in real operation. Such a regulation will be completely misleading particularly at production changes, starts, stops, etc. when the chemical balance in the system is altered drastically.

The object of the present invention is to achieve a perfectly satifactory control of peroxide bleaching both when the incoming raw materials very as when recycled chemicals from the bleaching are used for bleaching the pulp before the bleaching plant. The control of bleaching according to the invention means that excess use of bleaching chemicals can be avoided and considerable savings in bleaching chemicals have been made in actual practice of the present method. Another very important advantage is that flutuations due to factors stated above are avoided and the brightness of the outcoming material from the bleaching plant is very even which is of the greatest importance for the producer.

The control of bleaching according to the invention is directed to peroxide bleaching in more than one stage. The method is particularly applicable to bleaching with hydrogen peroxide, but can also be used for bleaching with other known peroxide bleaching agents for pulps, such as sodium peroxide and sodium percarbonate. Hydrogen peroxide bleaching is carried out in alkaline solution, usually within a pH range of from 6 to 12, and generally with hydrogen peroxide amounts of from 0.1 to 10 per cent by weight based on dry pulp. The pH is adjusted with alkaline agents, mainly caustic soda and water glass. According to known technique chelating agents such as EDTA and DTPA are used to eliminate the influence of contaminating metals.

The method of the invention is particularly applicable to two-stage bleaching plants where, in existing systems, the first stage is mainly used for a "passive "consumption of the chemicals remaining from the second bleaching stage. According to the invention the first stage is instead used "actively" for determination of the bleachability of the pulp. A known amount of chemicals is added to the first stage and is allowed to react under known conditions. The brightness from the first stage is then directly used for control of the conditions "feed-forward ", and mainly for the addition of chemcials in subsequent bleaching stages. The known amount of chemicals can be freshly added chemicals, recovered unreacted chemicals from subsequent stages or, which is most often the case, a mixture of these two types. The known amount of chemicals is alolowed to react under known conditions with regard to pH, temperature, time and pulp concentration. From practical experience it has been found that the freshly added bleaching chemicals to the first stage suitably should be from 5 to 60 per cent by weight of the totally added amount. In some cases it has been found that the amount of bleaching chemicals can be entirely covered by recycled chemicals. Alkali is usually added in this stage in an amoount corresponding to 20 to 60 or up to 80 per cent by weight of the total addition for the bleaching sequence. Besides the main use of the measured brightness after the first stage for control of "feed-forward "conditions, the level of brightness after the first stage can also be used for adjustment of the addition to the first stage, so that an optimum distribution of the chemical addition between the stages and the development of brightness over the stages is obtained.

Figure 2:
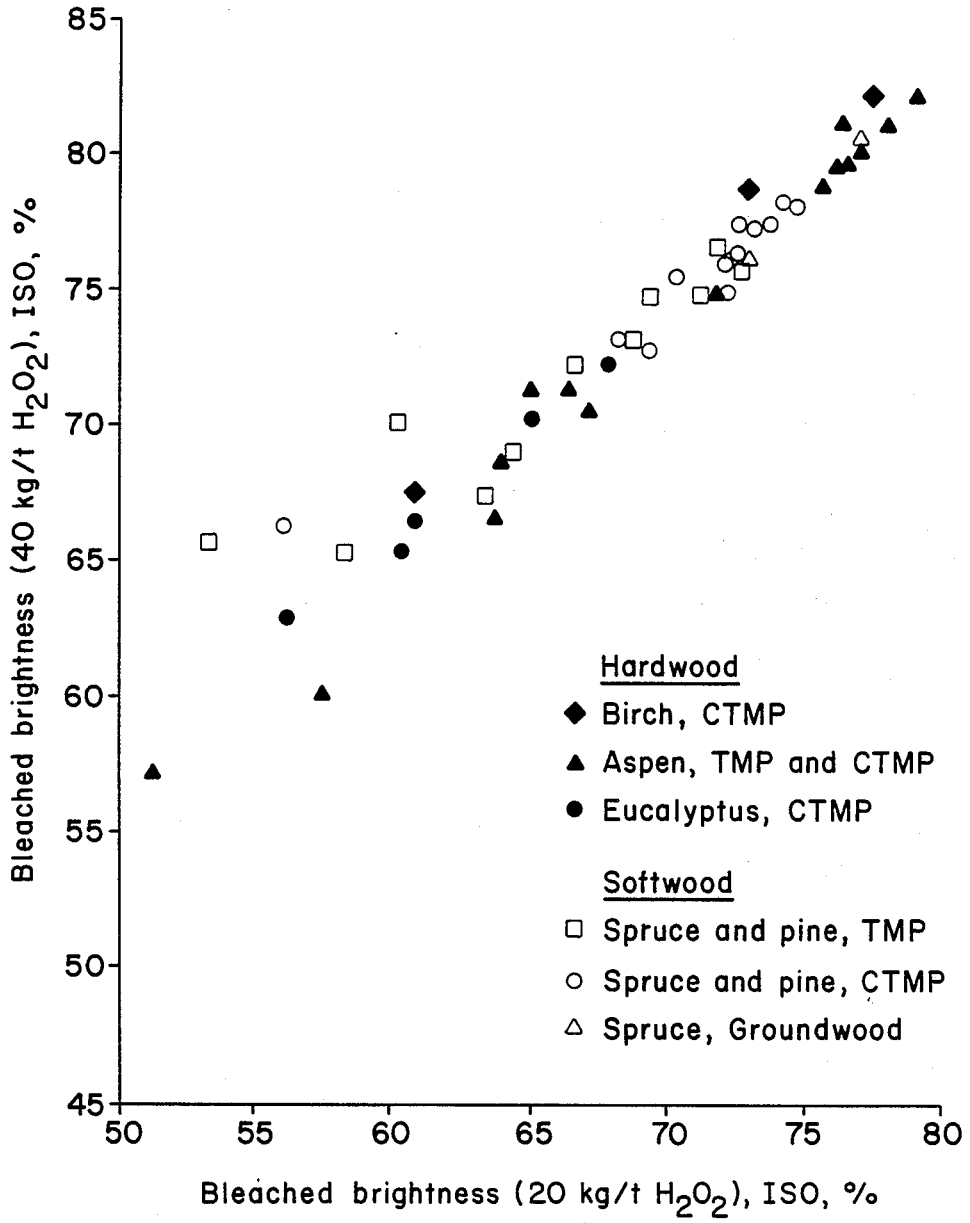
FIG. 2 shows the brightness of pulp at bleaching according to the present invention.

In FIG. 2 is shown the brightness of pulp bleached with 40 kg/t of hydrogen peroxide as a function of the brightness of the same pulp bleached with 20 kg/t of hydrogen peroxide. The alkali addition is optimized and in the same manner as in FIG. 1 different types of wood and different processes have been used. The brightness of the pulp after the finished bleaching with 40 kg of hydrogen peroxide per ton has been set against the brightness for the same pulp bleached with half the amount of chemical, 20 kg of hydrogen peroxide per ton. As evident from the figure the correlation is very good, and, further, in principle independent of both process and wood raw material, i.e. in total contrast to what is shown in FIG. 1.

Several runs have been made wherein the addition in stage two has been adjusted according to the brightness values from stage 1. Even at lower additions in stage 1, in the range of from 10 to 20% of the entire addition, a good correlation between the brightness of the finished bleached pulp and the value from stage one is obtained.

This good correlation is direct proof that the bleach results from a first bleaching stage which has been run under known conditions can be used directly for control of a subsequent stage, particularly in those cases where the aim is to achieve high brightness levels for the final bleached pulp.

Figure 3:
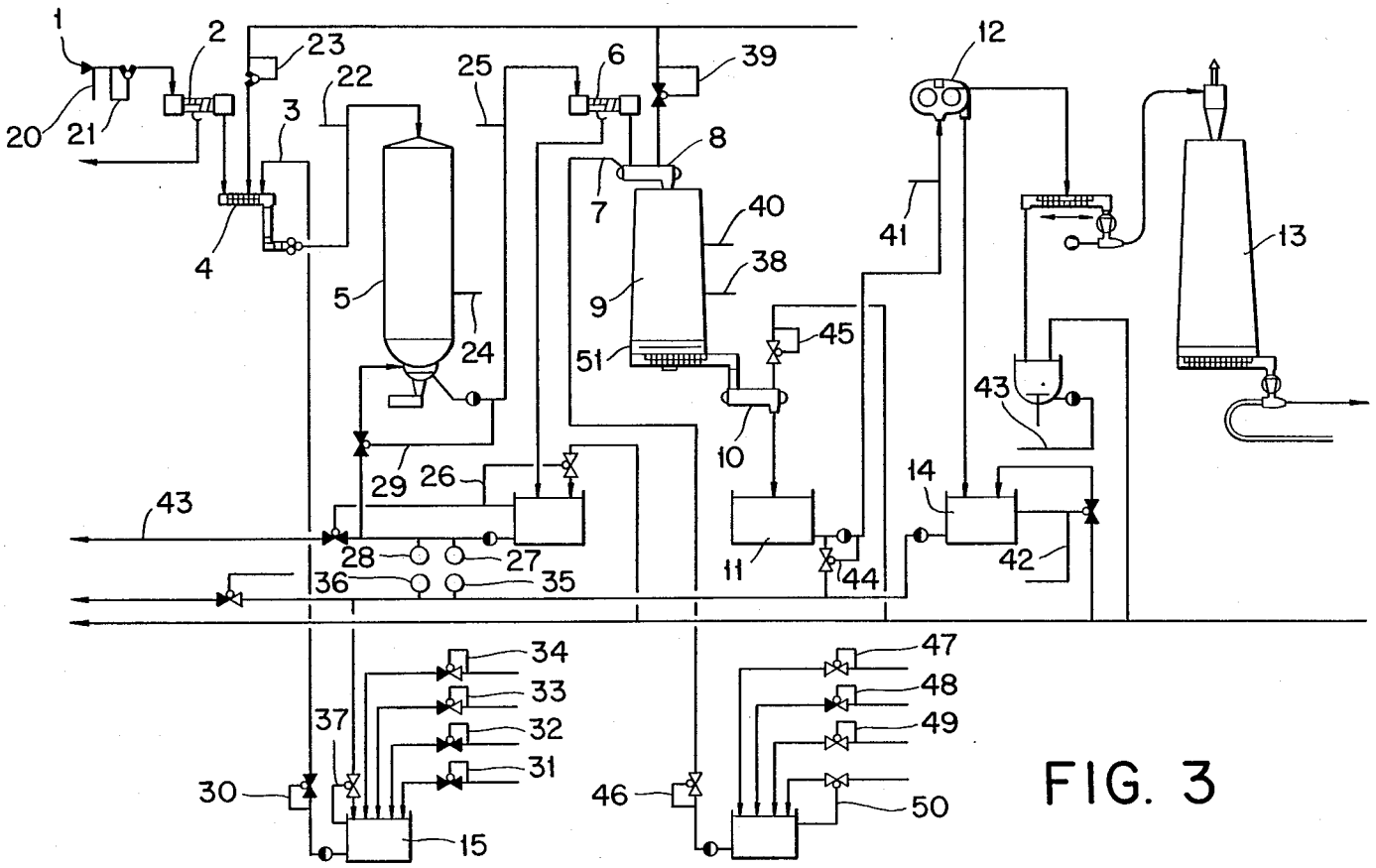
FIG. 3 shows the control of a peroxide bleaching system in two stages according to the invention.

In FIG. 3 an embodiment for control of a peroxide bleaching system in two stages is shown. The two-stage bleaching plant is integrated in a line for production of bleached market pulp. The production of the pulp before the bleaching plant can be mechanical, SGW, TMP, RMR, (Stone Ground Wood, Thermo Mechanical Pulp, Refiner Mechanical Pulp) etc, or chemimechanical, CTMP, CMP, NSSC, (Chemi-Thermo Mechanical Pulp, Chemical Mechanical Pulp, Neutral Sulphite Semi Chemical) etc.

The incoming pulp 1 is thickened in the press 2 to a pulp concentration of about 33%, mixed with bleaching chemicals 3 in the mixer 4 and bleached in the bleaching tower 5 of the first stage at a pulp concentration of about 10%. The bleached pulp is thickened to about 33% in the press 6 and the bleaching chemicals 7 for the second stage are then added in mixer 8. The pulp from the bleaching tower 9 of the second stage is diluted in the screw 10 and the pulp chest 11 and thickened in the press 12. The thickened pulp which has a dry solids content of about 50% is brought from the press to the storage tower 13 of the drier. The recovered, chemical-containing, white water from the press 12 is collected in a white water tank 14 and reused for dilutions after the bleaching tower. Excess of white water is reused in the first bleaching stage after required addition of fresh chemicals in the tank 15 for correciton of the dosage of chemicals to the first bleaching stage.

At bleaching according to the invention the control is made through measuring of different parameters in the production line and input of signals from the sensor to a computer which give control signals to different valves about regulators etc. The control system is shown in FIG. 3.

The production is determined by measuring pulp flow 20 and pulp concentration 21 up to the first stage. The production signals are used for regulation of the chemical flows in dependence of the production. The temperature 22 of the incoming pulp to stage 1 is measured and can be adjusted by steam addition 23. The level 24 in the tower 5 is used as a measure of the bleaching time. The bleaching results are continuously measured with a brightness meter 25 and the brightness value is used for regulation of a chemical addition to stage 2 and optionally for feed-back-regulation of the chemical addition to stage 1. The level of the white water tank is regulated 26 and the bleaching conditions in stage 1 are controlled by continuous measurement of pH 27 and residual peroxide 28 in the white water from the press 6 after the bleaching stage. The concentration of the pulp to the press 6 is controlled 29 by addition of white water. A flow 30, corresponding approximately to the balanced white water excess from stage 2, is used for the chemical addition in stage 1. The addition of fresh chemicals to stage 1 is regulated by the valves 31-34. DTPA 31 and sodium silicate 32 are added according to a set value in proportion to the production. The addition of fresh alkai 33 and peroxide 34 is adjusted with regard to the amount of alkali and residual peroxide in recycled white water measured with 35 and 36. The white water dilution to the mixing tank 15 is controlled by 37.

For the incoming pulp to stage 2 the temperature 38 is measured and can be adjusted by addition of steam 39. The level 40 is used as a measurement of the bleaching time. The bleach results of the pulp from stage 2 is controlled by brightness measurement 41. In the white water tank 14 the level 42 is regulated and at a too low level the tank is filled with warm water. At a too high level the excess of white water is pumped to the screen room 43. The level is balanced with regard to the volume taken out via 37. For control of the bleaching conditions in stage 2 the pH 35 and the peroxide content 36 in the white water from the press after the bleaching stage are continuously measured. The signals are also used for adjustment of the chemical additions to stage 1.

The conecentration regulation 44 of the pulp at the press 12 is made with white water from the press. The added amount of warm water 45 as wash water to stage 2 is selected with regard to the type of pulp produced and is set at a ratio to the production. The bleach liquid to stage 2 consists of a chemical solution diluted with water to avoid decomposition of the peroxide. The flow 46 is proportioned to the production. The composition is regulated by the meters 47, 48, 49 for peroxide, alkali and silicate, respectively. The addition is controlled by the bleachability, i.e. the brightness value from 25 with regard to the preoxide addition 34, the time 24, residual peroxide 28 and temperature 22 in stage 1 and proportioned to the production. A fresh water flow 50 is brought to the mixing tank for the chemicals. The outflow of the pulp from stage 2 is controlled by the regulator 51.

In practice it has been found that by control of the bleaching according to the invention the disadvantages of previous control methods are avoided and that an even and uniformly bleached pulp can be produced independent of variations in the raw material and/or the production. The disclosed embodiment can of course also be varied, within the scope of the invention, by the man skilled in the art for adaption to different plants. In the following example a typical bleaching operaion using the control system of the present invention is shown.

EXAMPLE

The control system was tried out in a CTMP mill producing pulp bleached in two stages using hydrogen peroxide. The pulp type was fluff with a freeness of about 600 CSF anf the target brightness was 76% ISO. The raw material was Scandinavian spruce with some pine admixture, less than 20%. The initial brightness before bleaching was 60 plus minus 0.5% ISO during the whole run.

The first bleaching stage was set to be run with a constant peroxide charge of 15 kg/ton of pulp. This was decided based on laboratory experiments giving a curve showing the amount of peroxide required to reach 76% ISO in stage two as a function of brightness in stage one when the charge in this was 15 kg/ton of pulp. This curve will in the following be referred to as alogorithm-15. It should be pointed out that algorithms have to be made up for each specific pulp and peroxide charge in stage one, raw material and final brightness target. This can be done in the laboratory or in the mill, e.g. with the aid of a computer.

The volumetric flow of spent liquor recycled from stage two was continuously monitored as was its content of residual peroxide.

At the start of the bleaching the amount of recirculated peroxide was obviously nil and thus the freshly added amount was 15 kg/ton. As the bleaching continued, the content of peroxide in the stream of spent liquor from stage two began to rise and consequently the freshly added amount was reduced so that the total charge to stage one was kept constant.

The brightness after stage one was also monitored continuously and the figure entered into algorithm-15 which delivered a target figure for the required total peroxide dosage in stage two. Also in stage two the total added peroxide is made up of freshly added chemical plu carry-over from stage one.

It was found that the brightness level of the finished pulp was within plus minus 0.5 ISO units from the required 76% ISO during the whole trial period which was one week. The value of the present method was thus amply demosnstrated.

The mill where the bleaching was run uses several wood suppliers and the chips are of different quality due to different storage and transport times etc. In the first two days of the run, the bleaching response in stage one turned out to be that 15 kg/ton of peroxide gave a brightness of 66% ISO which, in accordance with algorithm-15, required another 25 kg/ton in stage two. On the third day different quality chips were fed into the plant and bleaching response fell from 66 to 64% ISO after stage one. The algorithm-15 then prescribed 28.5 kg/ton of bleaching agent. Dosage in stage two was accordingly changed and final brightness was maintained at 76% ISO without interruption.

If the brightness response in stage one had not been detected immediately and correction in stage two not undertaken, then the brightness of the finished pulp would have been below target and the time elapsed before the plant could produce fully bleached grade would at least have been the holding time in stage two, in this case three hours. It should be pointed out that the initial brightness of the unbleached pulp did not change when the raw material was altered.

We claim:

1. A method for controlling peroxide bleaching of mechanical, thermomechanical and chemi-mechanical pulp in a plurality of bleaching stages, comprising the steps of bleaching the pulp in a first stage with a predetermined amount of bleaching chemicals containing peroxide and under predetermined reaction conditions, measuring the brightness of the pulp from this first stage and calculating the bleachability of the pulp as a function of the measured brightness and the predetermined amount of chemicals and predetermined reaction conditions, feedforwardly adjusting the amount of bleaching chemicals containing peroxide added in a second stage as a function of the calculated bleachability of the pulp from the first stage, and bleaching the pulp in the second stage.

2. A method according to claim 1, wherein the bleaching chemcials in the first stage are selected from the group consisting of fresh chemicals, chemicals recirculated from a subsequent bleaching stage, and mixtures thereof.

3. A method according to claim 1, wherein the addition of peroxide to the second stage is from about 40 to 100 percent weight of the total addition of peroxide.

4. A method according to claim 2, wherein the addition of peroxide to the second stage is from about 40 to 100 percent weight of the total addition of peroxide.

5. A method according to claim 1, wherein the bleaching chemcials in the first stage include white water recirculated from a subsequent bleaching, and wherein an amount of peroxide is added to the bleaching chemicals in the first stage as a function of the amount of peroxide in the white water.

6. A method according to claim 2, wherein the bleaching chemicals in the first stage include white water recirculated from a subsequent bleaching and wherein an amount of peroxide is added to the bleaching chemicals in the first stage as a function of the amount of peroxide in the white water.

7. A method according to claim 3, wherein the bleaching chemicals in the first stage include white water recirculated from a subsequent bleaching and wherein an amount of peroxide is added to the bleaching chemcials in the first stage as a function of the amount of peroxide in the white water.

8. A method according to claim 4, wherein the bleaching chemcials in the first stage include white water recirculated from a subsequent bleaching and wherein an amount of peroxide is added to the bleaching chemicals in the first stage as a function of the amount of peroxide in the white water.

9. A method according to claim 1, wherein the bleaching chemicals in the first stage include white water recirculated from a subsequent bleaching stage, the white water including alkali, and wherein an amount of alkali is added to the bleaching chemicals in the first stage as a function of the amount of alkali in the white water.

10. A method according to claim 2, wherein the bleaching chemicals in the first stage include white water recirculated from a subsequwent bleaching stage, the white water including alkali, and wherein an amount of alkali is added to the bleaching chemcials in the first stage as a function of the amount of alkali in the white water.

11. A method according to claim 3, wherein the bleaching chemicals in the first stage include white water recirculated from a subsequent bleaching stage, the white water including alkali, and wherein an amount of alkali is added to the bleaching chemicals in the first stage as a function of the amount of alkali in the white water.

12. A method according to claim 4, wherein the bleaching chemicals in the first stage include white water recirculated froma subsequent bleaching stage, the white water including alkali, and wherein an amount of alkali is added to the bleaching chemicals in the first stage as a function of the amount of alakli in the white water.

13. A method according to claim 1, wherein the method includes recovery of white water from the second stage, and wherein from about 40 to 100 percent by weight of the recovered white water is recirculated to the first stage.

14. A method according to claim 2, wherein the method includes recovery of white water from the second stage, and wherein from about 40 to 100 percent by weight of the recovered white water is recirculated to the first stage.

15. A method according to claim 3, wherein the method includes recovery of white water from the second stage, and wherein from about 40 to 100 percent by weight of the recovered white water is recirculated to the first stage.

16. A method according to claim 4, wherein the method includes recovery of white water from the second stage, and wherein from about 40 to 100 percent by weight of the recovered white water is recirculated to the first stage.

17. A method according to claim 1, wherein the peroxide is hydrogen peroxide.

18. A method according to claim 2, wherein the peroxide is hydrogen peroxide.

19. A method according to claim 3, wherein the peroxide is hydrogen peroxide.

20. A method according to claim 4, wherein the peroxide is hydrogen peroxide.

21. A method according to claim 5, wherein the peroxide is hydrogen peroxide.

* * * * *